United States Patent [19]

Zadro

[11] Patent Number: 4,733,468

[45] Date of Patent: Mar. 29, 1988

[54] SHAVING SYSTEM

[76] Inventor: Zlatko Zadro, 9641 Dove Cir., Fountain Valley, Calif. 92708

[21] Appl. No.: 830,178

[22] Filed: Feb. 18, 1986

[51] Int. Cl.[4] ..... B26B 19/38

[52] U.S. Cl. ..... 30/34 R; 30/41.5; 30/90; 132/80 R; 350/588

[58] Field of Search ..... 30/34 R, 41.5, 90; 132/80 R, 80 N; 350/588; 320/60, 61; 290/43, 54

[56] References Cited

U.S. PATENT DOCUMENTS 4,370,807 2/1983 O'Neill ..... 30/41.5

4,556,298 12/1985 Gottlieb ..... 350/588

*Primary Examiner*—Douglas D. Watts

[57] ABSTRACT

A shaving system is presented which comprises a lighted mirror, beard lubrication means, and a blade razor. The mirror is coupled beneath a shower. Water is tapped off the shower head and run through the mirror and a generator. The flow of water through the generator generates electricity which illuminates a low power light which is usually coupled to the top of the mirror. Water running through the mirror heats the mirror to water temperature, thereby preventing fogging. The water exits the mirror through a hose to the end of which a blade razor is connected. The end of the hose squirts water near the blade so that during shaving the beard, whiskers or hair is thoroughly moistened, therby making shaving more efficient.

1 Claim, 5 Drawing Figures

SHAVING SYSTEM

BACKGROUND OF THE INVENTION

1. Field of the Invention

The present invention relates to shaving apparatus and arrangements.

2. Background of the Prior Art

Shaving is a multi-billion dollar mega industry. Electric razors and pre-shave and post-shave lotions, blade razors and pre-shave creams and post-shave lotions and associated items annually separate consumers from many billions of dollars. Yet, except for the invention of the electric razor, which is not part of the present invention, there have been only minor refinements since the first cave man wet his face, looked into a reflecting pool, and used a sharpened rock to eliminate some of his beard. In earlier days for some people, shaving was probably a necessity. Alexander the Great had his soldiers shave so as to make their faces harder to grab in battle. Today, shaving is more a matter of appearance than necessity.

A vast amount of technical effort has been applied toward shaving. Blades are sharper and last longer. A wide variety of lubricants are available and perhaps some of them are as much better than others as they imply. Their basic function is to moisten the beard and skin so as to lubricate the passage of the blade which cuts the beard or hair.

Obviously this moistening of the beard would be easier in a shower where the air is moist because of the evaporation and water is available. Unfortunately, it is necessaary to have a mirror available for the average shaver to use in guiding the blade to minimize the chance of cutting and maximize the chance of removing all unwanted hair or beard. Those of us who are older, remember and the younger ones have seen in movies an old fashion shave where the barber put hot towels on the beard. This type of shave has many advantages if one could overcome the blade guidance problem.

An additional advantage to being in a shower is that water could constantantly be directed at the beard, thereby maximizing the amount of lubrication of the beard. With water being used, many billions of dollars now essentially wasted on creams, goos, perfumed soaps, and similar ointments could be saved. What is needed but not found in the prior art is someway of maximizing flow of water over the beard while not substantially reducing the ability of the shaver to precisely guide the blade.

In addition, it would be very helpful if more light could be transmitted to the shaver's face. The light must come from a source other than wall current which is of such high power that it might endanger the shaver. The light source and the power for the light source should be impervious to damage from 100% humidity and flowing water.

What is needed but neither shown nor disclosed by the prior art is a fogless mirror suitable for use in a shower or other places where there is moisture which utilizes heat from a flowing water source to heat the mirror and keep it fogless. Obviously, the same water could then be used for other uses.

SUMMARY OF THE INVENTION

A shaving system is presented. The shaving system comprises three parallel generally planar members of substantially identical dimensions. The first member, called herein the exterior member, is transparent to light. The second member is adjacent to the back surface of the transparent member which back surface is the interior surface of the transparent member The second member has a planar silver equivalent surface adjacent the back surface of the transparent member which silver equivalent surface reflects light transmitted in through the transparent member back out through the transparent member in a mirror like arrangement.

The third planar member is disposed parallel to the first and second members a very small distance behind the second planar member which is the center of the three planar members to form a very thin generally planar water flow chanber between the second and third members. Sides are disposed around the edges of the second and third parallel planar members to form a water flow chamber between the second and third members and to couple the three members together.

The water flow chamber has interior surfaces defining a water inlet port which in a first example is near the top of the mirror and a water outlet port which in a first example is at the bottom of the mirror. The water outlet port is of cross section not greater than the cross section of the water inlet port so that water cannot exit the water flow chamber faster than the water enters the chamber, thereby insuring that the transparent member remains at a temperature close to the flowing water temperature.

The outer surface of the mirror defining the inlet port and outlet port forms a protruding hose coupling surface capable of coupling to a hose in a substantially liquid tight coupling.

Mirror coupling means are capable of coupling the mirror near a shower head such that the silver equivalent surface which may be silver or aluminum paint such as typically used in mirrors faces substantially away from the nearest wall so it can be used as a mirror. A shower tap off coupler capable of coupling to the water pipe furnishes water to a shower head such that a very small percentage of the water flowing toward the shower head through the water pipe is diverted instead through the shower tap off coupler. The coupler has interior and exterior surfaces defining a water exit port including a protruding hose coupling surface capable of coupling to a hose in substantially liquid tight coupling.

A small water powered generator is capable of generating a small amount of electricity when water from the shower pipe via the shower tap off coupler flows therethrough. The generator has interior and exterior surfaces defining a water inlet port capable of mating with a hose coupled to the water outlet port of the shower tap off coupler. The interior and exterior surfaces of the generators define a water outlet port coupled in a liquid tight coupling to the water inlet port near the first edge of the mirror. Electrical coupling means couple electricity generated by the generator to a light means.

Lower power electric light means are coupled to receive power from the generator and illuminate whenever the generator transmits electricity through the generator electricity outlet. The light means is coupled near the top of the mirror to illuminate the volume of space adjacent to and near the mirror transparent surface.

Hose means are coupled between the water exit port of the shower tap off coupler and the water inlet port of the small water powered generator to transmit water from the shower tap off coupler to the generator.

A blade razor is used with the shaving system.

A particular example of a shaving system according to the present invention includes a mirror having a reflecting surface and having interior surfaces disposed near but not adjacent to the reflecting surface which interior surfaces defining water flow means near substantially all of the reflecting surface. As previously described, shower water tap off means are coupled to a water pipe furnishing water to a shower such that a very small percentage substantially less than 10% of the shower water is diverted from the shower head via the shower water tap off means to the mirror water flow means via shower-mirror coupling means. The surfaces of the mirror define water exit means coupled to water coupling means to permit water to flow out a water exit tube from the mirror. A blade razor may be coupled to the end of the water coupling means by razor coupling means so that the water exiting the coupling means is directed to the area being shaved.

DRAWING DESCRIPTION

Reference should be made at this time to the following detailed description, which should be read in conjunction with the following drawings, of which:

DETAILED DESCRIPTION

Figure 2:
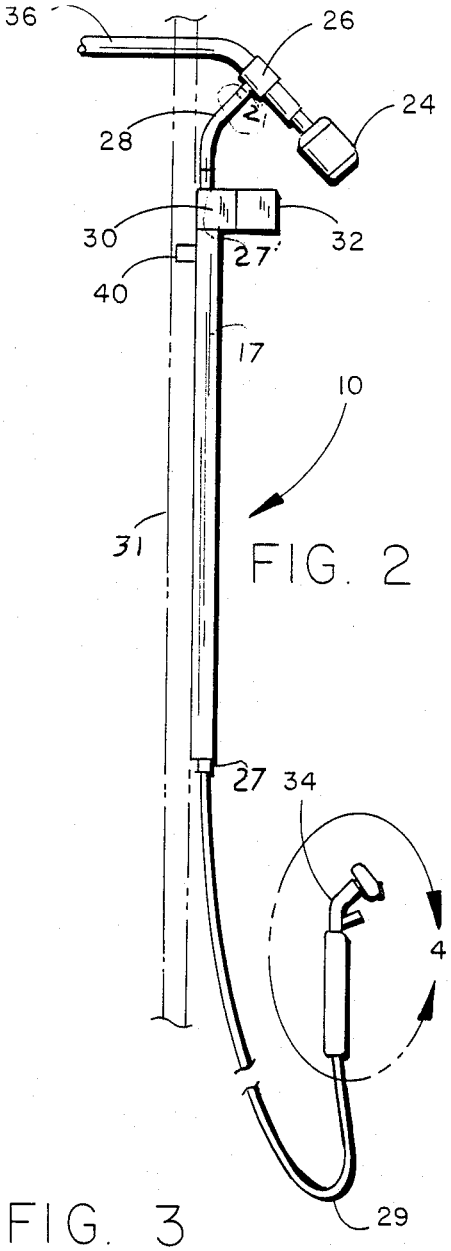
FIG. 2 illustrates a side view of the invention of FIG. 1.
Figure 1:
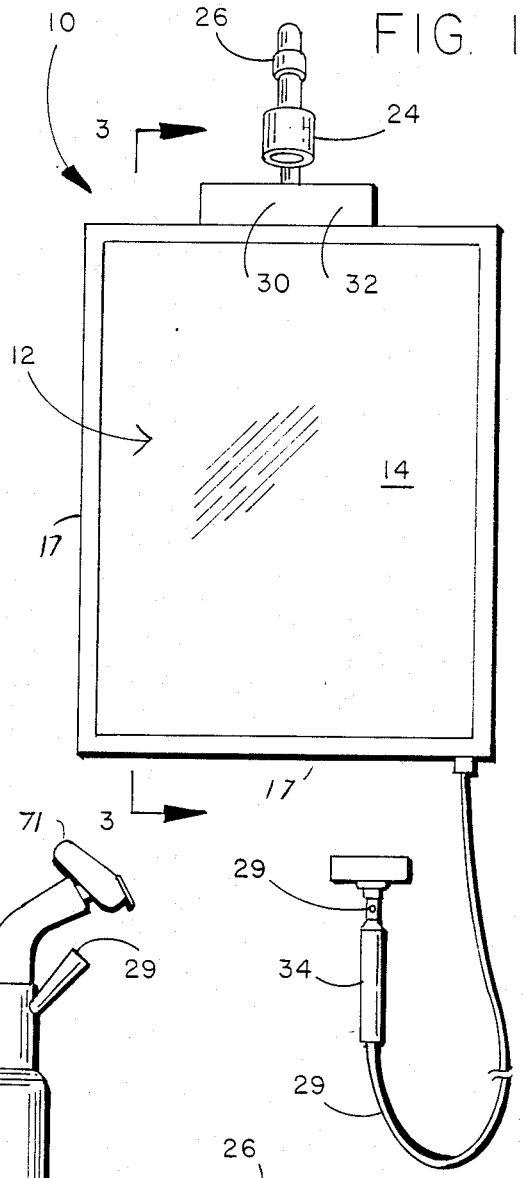
FIG. 1 illustrates a shaving system according to the present invention.
Figure 3:
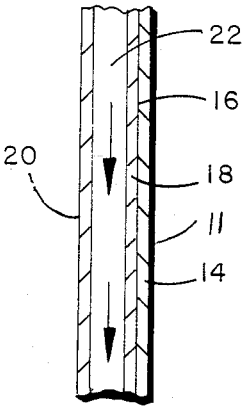
FIG. 3 illustrates a side view of water flow through the mirror of FIG. 1 along the line 3—3.
Figure 4:
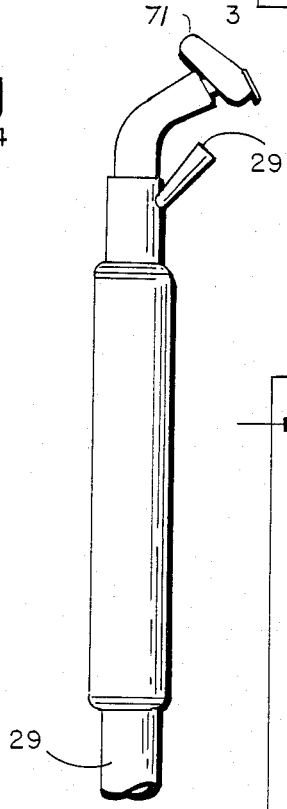
FIG. 4 illustrates in more detail the razor and water flow exit.

Reference should be made at this time to FIGS. 1–5 which illustrate various views of a shaving system 10 according to the present invention. The shaving system 10 comprises a mirror 12 comprising three generally planar members 14, 18, 20. The first member 14 is transparent. The second member 18 is adjacent to the back or interior surface of the transparent member 14 and has a planar silver equivalent surface 16 adjacent the transparent member 14 which silver equivalent surface 16 reflects light transmitted through the transparent member 14 in a mirror arrangement. The third planar member 20 is disposed parallel to the first member 14 and the second member 18 and the central parallel surface 16 which reflects light a very small distance from the second planar member 18 to form a very thin generally planar water flow chamber 22 between the second and third members 18, 20. Side 17 disposed around the edges of the three parallel planar members 14, 18, 20 form the water flow chamber 22 in a water tight coupling. The water flow chamber 22 has interior surfaces defining a water inlet port 27' and a water outlet port 27 along opposite edges. The water outlet port 27 is of cross section not greater than the cross section of the water inlet port 27'. The outer surface of the mirror 12 defining each of said ports 27, 27' forms a protruding hose coupling surface 27, 27' capable of coupling to a hose 28, 29 in a substantially liquid tight coupling. Mirror coupling means 40 capable of coupling the mirror near a shower head 24 in such a manner that the silver equivalent surface 16 faces substantially away from the nearest wall 31 are utilized to couple the mirror 12 and associated parts of the invention 10 to a wall 31 beneath the shower head 24.

Figure 5:
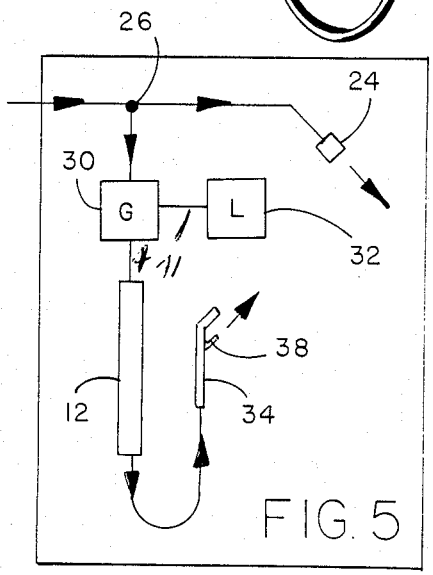
FIG. 5 is a block diagram of the invention showing electrical power generation and flow.

As shown in FIG. 2 and in block diagram in FIG. 5, water flows through a shower pipe 36 to a shower tap off coupler 26 capable of coupling to the shower water pipe 36 such that a very small percentage of the water flowing toward the shower head 24 through the water pipe 36 is diverted instead through the shower tap off coupled 26 which coupled 26 has interior and exterior surfaces defining a protruding hose coupling surface 21 capable of coupling to a hose 28 in a substantially liquid tight coupling.

A small water powered generator 30 capable of generating a small amount of electricity when the water from the shower pipe 36 via the shower tap off coupler 26 flows through the generator 30. The generator 30 utilizes the interior and exterior surfaces defining the water inlet port 27' of the mirror 12 which port 27' is capable of and does mate with the hose 28 coupled to the water outlet port 21 of the shower tap off coupler 26. The interior and exterior surfaces of the generator 30 define a water outlet port (interior and so not shown) coupled in a liquid tight coupling to the water inlet port near the first edge of the mirror 12. In the example illustrated, the generator 30 is actually built into the top of the mirror 12 so that water flows through the generator 30 into the mirror 12 water flow chamber 22 and the volume adjacent the generator 30 and the adjacent part of the chamber 22 forms the water outlet port of the generator 30 and the water inlet port of the mirror 12. Electrical coupling means 441 couple electricity generated by the generator 30 to a low power electric light means 32 via the coupling means 441. The low power electric light means couple to receive power from the generator 30 illuminate whenever the generator transmits electricity through the electrical coupling means 441 which are the generator electricity outlet 441. The light means 32 is coupled near the top of the mirror 12 to illuminate the volume of space adjacent to and near the mirror transparent surface 14 which during normal operation includes the face of the shaver (not shown).

There is no connection to an external power source, so there is no chance that enough current could be generated to injure by shocking the user. The pick off hose 28 from the water pipe 36 is a narrow diameter hose 28 $\frac{1}{4}$ inch in diameter in the first example of the invention 10 and taps off much less than 10% of the water flowing through the pipe 36 with the balance exiting the shower head 24 in the normal fashion.

In operation, the water keeps the transparent member 14 of the mirror 12 heated so that water vapor does not condense on the exterior surface 11 of transparent member 14 so as to fog the surface 11 and prevent viewing. The extra temperature keeps the surface 11 clear so that the mirror 12 remains clear so that it can be used for shaving.

The water from the pipe 36 exits the mirror via outlet port 27 and razor hose 29 which exits near the head 71 of razor 34 so that there is a thin stream of water more or less constently spraying on the skin of the user near the razor head 71 to lubricate the beard or hair to be cut. The hose 29 may exit via a nozzle 38 of a type known to the prior art such as a fan spraying nozzle which spreads the water in a desired fashion.

The system 10 permits shaving with lubrication better than foam because of the spray from the hose 29 and the vapor from the shower head 24 water output lubricates so well. There is no mess because the whiskers or hair are rinsed off by the shower water. Foam can, of course, be used, but is not needed. There is no electric plug. There are no batteries or refills. There are no chemicals. The light 32 turns on when the shower turns on. The razor34 may be of any of the type known to the prior art which can couple to a hose 29. Some of the prior art razors have hollow handles, So no names to clamp the hose 29 to the razor 34 are shown, although such a clamp could be utilized if necessary for a particular razor 34. When done, the hose 29 holds the razor 34 below the mirror 12 until it is desired to again operate the system 10. The razor 34 shown in FIG. 1 has a handle which is hollow and therefore adapted to be coupling means coupling the razor 34 to the hose 29 which also may be referred to as water coupling means 29. The mirror 12 in the example shown has a reflecting surface 16 and has interior surfaces best shown in FIG. 3 disposed near but not adjacent to the reflecting surface 16 which interior surfaces define water flow means 22 near substantially all of the reflecting surface 16. While an example involving three parallel generally planar members 14, 18, 20 has been shown, a wide variety of other means of causing water to flow near the reflecting surface 16 could be used in a variety of different shapers and still be within the scope of the present invention.

A variety of shower water tap off means coupling to a water pipe in different arrangements to tap off a small amount of water would also be within the scope of the present invention so long as the water was diverted via tap off means to mirror water flow means via shower coupling means as described previously.

A particular example of the invention has been described herein. Other examples will be obvious to those skilled in the art . The invention is limited only be the following claims.

I claim:

1. A shaving system comprising:

a mirror comprising three parallel generally planar members, the first member being transparent, the second member adjacent to the back surface of the transparent member having a planar silver equivalent surface adjacent the transparent member which silver equivalent surface reflects light transmitted through the transparent member in a mirror arrangement, the third planar member being disposed parallel to the second member and central parallel surface a very small distance from the second planar member to form a very thin generally planar water flow chamber between the second and third members, sides disposed around the edges of the three parallel planar members to form said water flow chamber between the second and third members, the water flow chamber having interior surfaces defining a water inlet port and a water outlet port along opposite edges, the water outlet port of cross section not greater than the cross section of the water inlet port, the outer surface of the mirror defining each of said ports forming a protruding hose coupling surface capable of coupling to a hose in a substantially liquid tight coupling;

mirror coupling means capable of coupling the mirror near a shower head such that the silver equivalent surface faces substantially away from the nearest wall;

a shower tap off coupler capable of coupling to the water pipe furnishing water to a shower head such that a very small percentage of the water flowing toward the shower head through the water pipe is diverted instead through the shower tap off coupler which coupler has interior and exterior surfaces defining a water exit port including a protruding hose coupling surface capable of coupling to a hose in a substantially liquid tight coupling;

a small water powered generator capable of generating a small amount of electricity when water from the shower pipe via the shower tap off coupler flows therethrough, the generator having interior and exterior surfaces defining a water inlet port capable of mating with a hose coupled to the water outlet port of the shower tap off coupler, and the interior and exterior surfaces of the generator defining a water outlet port coupled in a liquid tight coupling to the water inlet port near the first edge of the mirror, electrical coupling means coupling electricity generated by the generator to a light means via an electricity outlet;

low power electric light means coupled to receive power from the generator and illuminate whenever the generator transmits electricity through the generator electricity outlet, the light means coupled near the top of the mirror to illuminate the volume of space adjacent to and near the mirror transparent surface;

hose means coupled between the water exit port of the shower tap off coupler and the water inlet port of the small water powered generator to transmit water from the shower tap off coupler to the generator;

a razor; and hose means coupled between the water outlet port near the bottom of the mirror to the razor and coupled to the razor in such a manner that water from the mirror flows out of the hose means nearly adjacent the blade of the razor.

* * * * *